US007976010B2

(12) United States Patent
Grögor et al.

(10) Patent No.: US 7,976,010 B2
(45) Date of Patent: Jul. 12, 2011

(54) DEVICE FOR SINGULATING OVERLAPPING FLAT MAILINGS

(75) Inventors: Erich Grögor, Constance (DE); Hauke Lübben, Radolfzell (DE); Michael Schwarzbauer, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 832 days.

(21) Appl. No.: 10/577,202

(22) PCT Filed: Sep. 14, 2004

(86) PCT No.: PCT/EP2004/010254
§ 371 (c)(1),
(2), (4) Date: Dec. 26, 2006

(87) PCT Pub. No.: WO2005/051816
PCT Pub. Date: Jun. 9, 2005

(65) Prior Publication Data

US 2007/0085259 A1 Apr. 19, 2007

(30) Foreign Application Priority Data

Oct. 29, 2003 (DE) ..... 103 50 352

(51) Int. Cl.
*B65H 5/22* (2006.01)

(52) U.S. Cl. ..... 271/4.06; 271/121

(58) Field of Classification Search ..... 271/111, 271/121, 122, 129, 132, 4.06, 104, 137, 167
See application file for complete search history.

(56) References Cited

U.S. PATENT DOCUMENTS 1,858,320 A 5/1932 Beardsley et al.
2,941,653 A 6/1960 Kriemelmeyer, Jr
3,347,348 A 10/1967 Flint et al.
(Continued)

FOREIGN PATENT DOCUMENTS

FR 2 657 857 A1 8/1991
(Continued)

OTHER PUBLICATIONS

Derwent Abstract—FR-2 657 857 A1; Aug. 9, 1991; Sociéteanonyme dite BERTIN & CIE, France.

(Continued)

*Primary Examiner* — Stefanos Karmis
*Assistant Examiner* — Thomas A Morrison
(74) *Attorney, Agent, or Firm* — Laurence A. Greenberg; Werner H. Stemer; Ralph E. Locher

(57) ABSTRACT

A device for singulating overlapping flat mailings in an upright position in a path of travel has several singulating sections arranged along the path of travel. Each singulating section has conveyor belts spaced apart from each other and above each other and transporting the mailings. At an opposite side of the path of travel, each singulating section has retaining elements acting on the mailings with a friction force and at a height between the conveyor belts. A speed of travel of the conveyor belts in each singulating section is higher than the speed of travel of the conveyor belts of the respective singulating section upstream in the direction of travel. Further, individually mounted deflection rollers of the conveyor belts of both adjacent singulating sections are arranged at different heights along a common axis at each transition between the singulating sections.

13 Claims, 2 Drawing Sheets

U.S. PATENT DOCUMENTS

| | | | | | |
|---|---|---|---|---|---|
| 3,372,925 | A | | 3/1968 | De Vries et al. | |
| 3,485,488 | A | * | 12/1969 | Ellison | 271/4.01 |
| 3,847,383 | A | * | 11/1974 | Wojtowicz et al. | 271/11 |
| 5,238,236 | A | * | 8/1993 | Belec et al. | 271/34 |
| 5,257,777 | A | * | 11/1993 | Kalika et al. | 271/35 |
| 5,429,347 | A | | 7/1995 | Leonard | |
| 6,135,441 | A | | 10/2000 | Belec et al. | |
| 6,443,444 | B1 | | 9/2002 | Cera et al. | |

FOREIGN PATENT DOCUMENTS

| | | | |
|---|---|---|---|
| FR | 2 679 593 A1 | | 1/1993 |
| JP | 2-8123 | * | 1/1990 |

OTHER PUBLICATIONS

Derwent Abstract —FR-2 679 539 A1; Jan. 29, 1993; Compagne Generale D'Automatisme CGA-HBS SociétéAnonyme, France.

* cited by examiner

DEVICE FOR SINGULATING OVERLAPPING FLAT MAILINGS

CROSS REFERENCE TO RELATED APPLICATIONS

The present application is a national phase application of international application PCT/EP2004/010254, filed Sep. 14, 2004, and claims priority to German application 103 50 352.8, filed Oct. 29, 2003, the both of which are herein incorporated by reference.

BACKGROUND OF THE INVENTION

The invention relates to a device for singulating overlapping flat mailings.

Single-stage (U.S. Pat. Nos. 3,372,925; 2,941,653) and multistage (U.S. Pat. No. 6,135,441 A) singulating devices are known. For multistage singulating devices the individual stages of the singulating device are spatially separated from each other. These are belt drive groups (U.S. Pat. No. 6,135,441 A) arranged separately one behind the other. This means that gaps (roller diameter+twice belt thickness+safety distance) occur between the individual stages in the conveyor system. The mailings are no longer supported over their complete length in these transition gaps, but instead only driven/held over a short belt length. Because of this, uncontrolled changes in position (rotations) of the mailings can occur during accelerating (braking). When the front edge enters the succeeding conveyor section brief travel malfunctions, or damaged mailings (folding) can occur, depending on the angle at which the front edge of the mailing contacts the end of the roller.

The device known from U.S. Pat. No. 2,941,653 includes a singulating section in which the mailings are also accelerated and an acceleration section in which the mailings are further accelerated and in which additionally, in the case of a double conveyance, one of the two mailings is discharged.

In the known solutions, the position of the mailings is monitored by means of light barriers.

From FR 2 657 857 A1 the transfer of mailings over a transition gap between two transport sections with different travel speeds is known. From U.S. Pat. No. 3,372,925, U.S. Pat. No. 2,941,653 and U.S. Pat. No. 1,858,320 it is known in each case how mailings can be transferred between two conveyor sections at different travel speeds without transition gaps. Individually mounted deflection rollers of the conveyor belts of two adjacent conveyor sections arranged at an alternating height on a common axis are known for this purpose from U.S. Pat. No. 3,372,925 and from U.S. Pat. No. 1,858,320.

SUMMARY OF THE INVENTION

The object of the invention is to provide a device for singulating overlapping flat mailings, that even where the mailings differ considerably with regard to length, height, thickness or stiffness, has a high throughput, a low overlap rate at the end of the device and a low mailing damage rate.

Accordingly, one aspect involves a device for singulating overlapping flat mailings in an upright position in a path of travel with several singulating sections arranged along the path of travel. Each singulating section has conveyor belts spaced apart from each other and above each other and transporting the mailings. At an opposite side of the path of travel, each singulating section has retaining elements acting on the mailings with a friction force and at a height between the conveyor belts. A speed of travel of the conveyor belts in each singulating section is higher than the speed of travel of the conveyor belts of the respective singulating section upstream in the direction of travel. Further, individually mounted deflection rollers of the conveyor belts of both adjacent singulating sections are arranged at different heights along a common axis at each transition between the singulating sections.

In this case, the speed of travel of the conveyor belts in each singulating section is greater than the speed of travel of the conveyor belts of the singulating section located upstream thereof in the direction of travel. Individually mounted deflection rollers of the conveyor belts of both adjacent singulating sections are placed at different heights along a common axis at each transition between the singulating sections. Thus when singulating there is a multistage acceleration without transition gaps between the stages, which enables an absolutely impact-free mailing transition to the succeeding singulating section. Because of the multistage arrangement, the forces acting on the mailings during acceleration can be kept relatively low.

Advantageous embodiments of the invention are shown in the subclaims. To ensure a safe transition of mailings to the succeeding singulating section without shifting relative to each other, it is advantageous if the conveyor belts receiving the mailings have a higher coefficient of friction than the conveyor belts transferring the mailings.

In this connection it is furthermore advantageous to arrange the mailings behind the receiving conveyor belts in the transition area at vacuum chambers pulling the conveyor belts.

Furthermore, it is advantageous for this purpose if at each transition between the singulating sections the receiving area of the downstream singulating section has one conveyor belt more than the transferring area of the upstream singulating section. The middle singulating sections in this case have two conveyor belt areas connected by a common wide coupling roller, with the receiving conveyor belt area in these singulating sections of the particular mailings having one conveyor belt more than the transferring conveyor belt area.

To monitor and control the singulating in the singulating sections, each singulating section advantageously has a measuring device for recording the speed of the mailings in the receiving area.

So that no interfering forces act on the mailings during the transition of the mailings to the downstream singulating section and to better separate overlapping mailings, it is therefore advantageous if the drive of the conveyor belts of the singulating section upstream in each case in the direction of travel can be switched off or its speed reduced, if the mailing arriving in the particular downstream singulating section has reached the speed of the receiving conveyor belts. The switch off and reduction persists until a clearance between the mailings, specified for each singulating section, has been determined by a line of light barriers arranged along the path of travel.

In this connection it is also advantageous that, in addition to the vacuum of the vacuum chamber of the upstream singulating section in the direction of travel in each case can be switched off or reduced, if the incoming mailing to the downstream singulating section in each case reaches the speed of the receiving conveyor belt. The shutdown and reduction persists until a clearance between the mailings, specified for each singulating section, has been determined by a line of light barriers arranged along the path of travel.

For a cost-effective and flexible arrangement of the retention function it is advantageous if the retention element is secured to an immovable belt running along the length of all singulating sections.

BRIEF DESCRIPTION OF THE SEVERAL VIEWS OF THE DRAWINGS

The invention is explained with the aid of drawings using an exemplary embodiment.

The drawings are as follows.

DETAILED DESCRIPTION OF THE INVENTION

Figure 1:
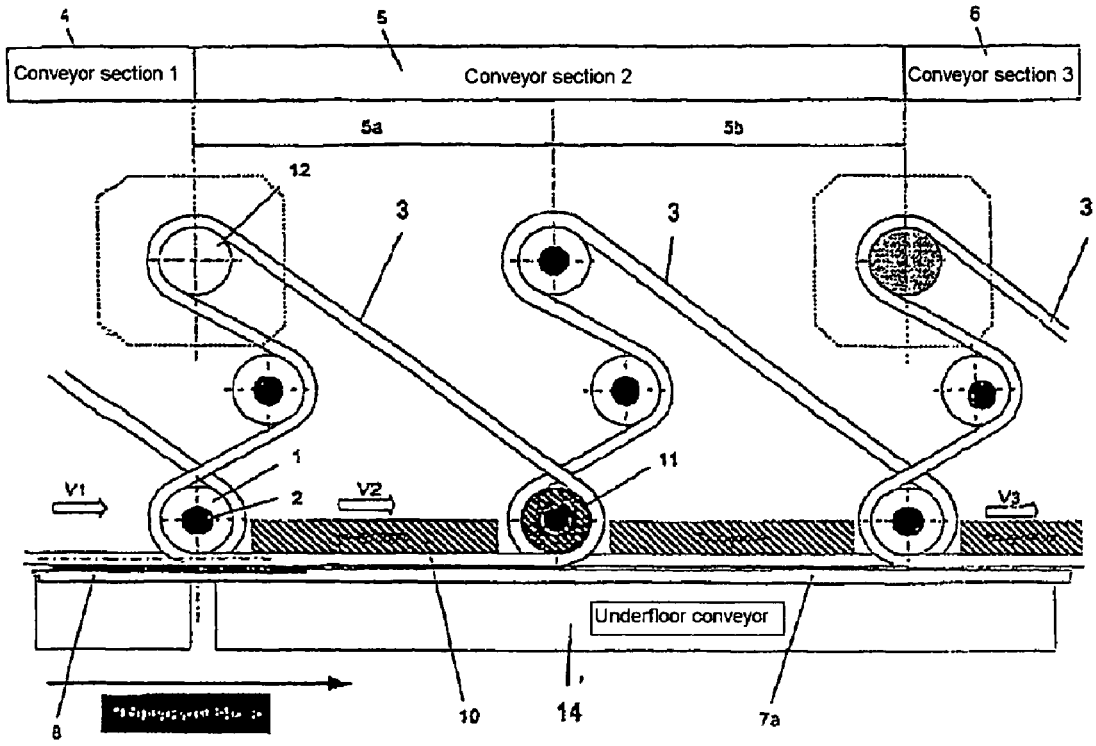
FIG. 1 A plan view of a section of the path of travel.
Figure 2:
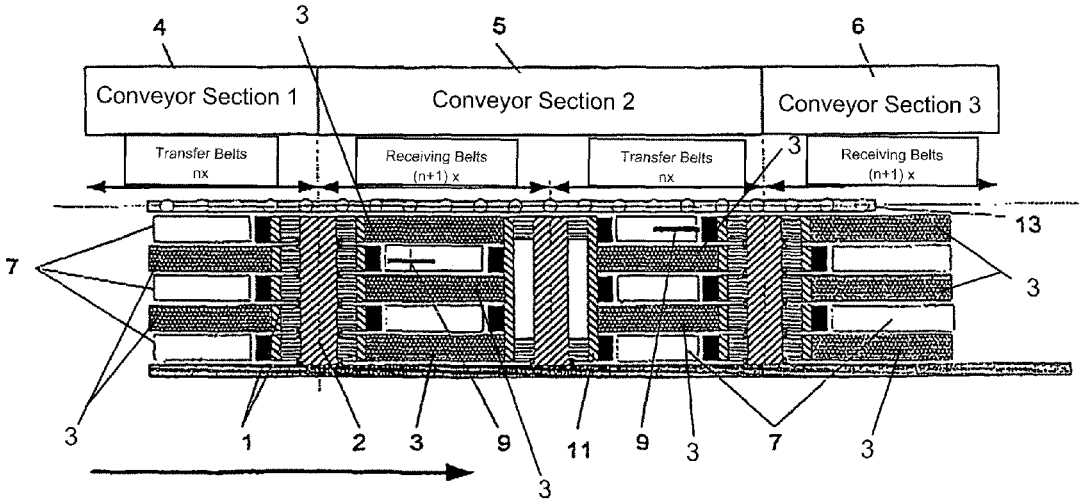
FIG. 2 A section view through the deflection rollers of the conveyor belts at the transition between the singulating sections.

Individually mounted deflection rollers 1 of the conveyor belts 3, that are driven by a drive motor 12 in each singulating section 4, 5, 6, are mounted on a common axis 2 at each transition of the singulating sections 4, 5, 6. The transition gap in the mailing stream of the vertical mailings, that stand on an underfloor conveyor 14 in the path of travel, is thus reduced to 0 mm. This arrangement enables an absolutely impact-free mailing transfer to the succeeding singulating section 5.6.

Due to the alternating arrangement of the conveyor belts 3 in the individual singulating stages 4, 5, 6, the retaining elements 7, acting between the conveyor belts 3, of the immoveable belt 7*a* must also alternate in height. Mailings 8 that have caught on one another on holes or clips, i.e. multiple extractions, can be more easily separated from each other due to the different contact points of the retaining elements 7 on the mailings 8.

The conveyor belts 3 forming a closed contact area in the direction of travel at the deflection rollers 1 in combination with a measuring device 9 measuring the speed of the mailings enable a precise control of the mailings within all singulating sections 4, 5, 6. The first singulating section 4, that can only be partially seen (mailing stack and feeder bed are not illustrated) has a defined lower speed V1 than the succeeding singulating unit 5 with speed V2. The speed of the mailings is continuously scanned by the measuring device 9. If in the singulating section 5 this speed reaches V2, the first singulating section 4 is immediately switched off and kept switched off (or if appropriate only reduced in speed) until a specified gap is detected by a line of light barriers 13. The overlapping belt arrangement at the transfer points of the singulating sections 4, 5, 6 guarantees that a mailing that is still in the feeding first singulating section 4 is retained. The earliest possible separation (gap creation) of the mailings is thus achieved.

If the conveyor belt is additionally supported by vacuum, stationery vacuum chambers 10 of the particular receiving singulating section 5, 6 are advantageously arranged close to the transition to the previous singulating section 4, 5. The mailing to be accelerated is in the succeeding singulating section 5 pulled early by means of its vacuum chamber 10 onto its conveyor belt 3, so that the driving force is increased.

The early and safe transfer of mailings is further supported by the following feature:

The singulating sections 4, 5, 6 are divided so that when entering the succeeding singulating section 5, 6 running at higher speed one conveyor belt more than at the section end of the transferring singulating section 4, 5 is present. The driving forces of the receiving singulating section 5, 6 on the mailing are therefore greater than the driving forces of the transferring singulating section 4, 5.

The center singulating section 5 is additionally divided into a receiving area 5*a* and a transfer area 5*b* to maintain the above condition. The drive coupling of the two areas 5*a*, 5*b* in this example consists of a wide coupling roller 11. The complete singulating section 5 here is driven by a motor 12.

The invention claimed is:

1. Device for singulating overlapping flat mailings in an upright position in a path of travel comprising:

first, second, and third singulating sections disposed along the path of travel with an ensemble of conveyor belts, each of said first, second, and third singulating sections having respective conveyor belts of said ensemble of conveyor belts spaced apart from each other and above each other for transporting the mailings, and each of said first, second, and third singulating sections having, at an opposite side of the path of travel, respective retaining elements for acting on the mailings with a friction force and at a height between the conveyor belts, wherein said conveyor belts in said third singulating section are configured to have a speed of travel that is higher than the speed of travel of said conveyor belts of said second singulating section, which is disposed upstream of said third singulating section in the direction of travel, and said conveyor belts in said second singulating section are configured to have a speed of travel that is higher than the speed of travel of said conveyor belts of said first singulating section, which is disposed upstream of the second singulating section in the direction of travel, said first singulating section being provided with a first deflection roller of said conveyor belts of said first singulating section, said second singulating section being provided with second and third deflection rollers of said conveyor belts of said second singulating section, and said third singulating section being provided with a fourth deflection roller of the conveyor belts of said third singulating section, said first and second deflection rollers being disposed at different heights along a common axis at a transition between said first and second singulating sections, and said third and fourth deflection rollers being disposed at different heights along a common axis at a transition between said second and third singulating sections.

2. Device in accordance with claim 1, wherein said ensemble of conveyor belts has conveyor belts for receiving the mailings and respective transferring conveyor belts, said conveyor belts receiving the mailings have a higher coefficient of friction than said respective transferring conveyor belts.

3. Device in accordance with claim 1, wherein behind receiving conveyor belts of the ensemble of conveyor belts in a receiving area the mailings are arranged at vacuum chambers pulling the receiving conveyor belts.

4. Device in accordance with claim 1, wherein at said transition between the first and second singulating sections a receiving area of the second singulating section has one more conveyor belt than a transferring area of the first singulating section, and at a transition between said second and third singulating sections a receiving area of said third singulating section has one more conveyor belt then a transferring area of said second singulating section.

5. Device in accordance with claim 1, wherein each singulating section has a measuring device in a receiving area for recording a speed of the mailings.

6. Device in accordance with claim 5, wherein a drive motor of the conveyor belt of each of the upstream singulating sections in the direction of travel can be switched off or reduced in speed if the mailing arriving in the respective downstream singulating section has achieved a speed of a receiving conveyor belt of said ensemble of conveyor belts, and the switch-off or reduction persists until a clearance between the mailings, specified for each singulating section, has been determined by means of a line of light barriers arranged along the path of travel.

7. Device in accordance with claim 3, wherein additionally a vacuum of the vacuum chamber of each singulating section upstream in the direction of travel can be switched off or reduced if the corresponding mailing arriving in a succeeding singulating section has reached a speed of a receiving conveyor belt of said ensemble of conveyor belts, and the switch-off and or reduction persists until a clearance between the mailings, specified for each singulating section, is determined by means of a line of light barriers arranged along the path of travel.

8. Device in accordance with claim 1, wherein the retaining elements are secured on an immoveable belt running along the length of all singulating sections.

9. The device according to claim 4, wherein said second singulating section is divided into an upstream receiving conveyor belt area for receiving the mailings from the first singulating section and a downstream transferring conveyor belt area, each of said conveyor belt areas being provided with respective conveyor belts coupled by a common coupling roller, and said upstream receiving conveyor belt area having one more conveyor belt than said downstream transferring conveyor belt area.

10. The device according to claim 1, wherein said retaining elements of said first, second, or and third singulating sections alternate in height to correspond to the height of the respective deflection rollers.

11. A method for singulating overlapping flat mailings in an upright position in a path of travel, comprising:

providing a device having first, second, and third singulating sections disposed consecutively along the path of travel with an ensemble of conveyor belts, each of the first, second, and third singulating sections having respective conveyor belts of the ensemble of conveyor belts spaced apart from each other and above each other for transporting the mailings, and each of the first, second, and third singulating sections having, at an opposite side of the path of travel, respective retaining elements for acting on the mailings with a friction force and at a height between the conveyor belts, the first singulating section being provided with a first deflection roller of the conveyor belts of the first singulating section, the second singulating section being provided with second and third deflection rollers of the conveyor belts of the second singulating section, and the third singulating section being provided with a fourth deflection roller of the conveyor belts of the third singulating section, the first and second deflection rollers being disposed at different heights along a common axis at a transition between the first and second singulating sections, and the third and fourth deflection rollers being disposed at different heights along a common axis at a transition between the second and third singulating sections;

driving the conveyor belts in the second singulating section with a speed of travel which is greater than the speed of travel of the conveyor belt of the first singulating section disposed upstream of the second singulating section in the direction of travel; and driving the conveyor belts in the third singulating section with a speed of travel of which is greater than the speed of travel of the conveyor belts of the second singulating section, which is disposed upstream of the third singulating section in the direction of travel.

12. The method according to claim 11, further comprising:

switching off or reducing the speed of a drive motor of the conveyor belts of the first singulating section if the mailing arriving in the second singulating section has achieved the speed of a receiving conveyor belt of the second singulating section;

maintaining the switching off or the reduction of speed until a clearance between the mailings specified for the first singulating section has been determined by a line of light barriers disposed along the path of travel;

switching off or reducing the speed of a drive motor of the conveyor belts of the second singulating section if the mailing arriving in the third singulating section has achieved the speed of a receiving conveyor belt of the third singulating section; and maintaining the switching off or the reduction of speed until a clearance between the mailings specified for the second singulating section has been determined by a line of light barriers disposed along the path of travel.

13. The method according to claim 11, further comprising:

switching off or reducing the vacuum of a vacuum chamber of the first singulating section if the mailing arriving in the second singulating section has achieved the speed of a receiving conveyor belt of the second singulating section;

maintaining the switching off or the reduction of vacuum until a clearance between the mailings specified for the first singulating section has been determined by a line of light barriers disposed along the path of travel;

switching off or reducing the vacuum of a vacuum chamber of the second singulating section if the mailing arriving in the third singulating section has achieved the speed of a receiving conveyor belt of the third singulating section; and maintaining the switching off or the reduction of vacuum until a clearance between the mailings specified for the second singulating section has been determined by a line of light barriers disposed along the path of travel.

* * * * *